US007862205B2

(12) United States Patent
Bertram et al.

(10) Patent No.: US 7,862,205 B2
(45) Date of Patent: Jan. 4, 2011

(54) LIGHTING UNIT AND LAMP

(75) Inventors: Ralph Bertram, Nittendorf (DE); Simon Schwalenberg, Regensburg (DE); Jan Marfeld, Schrobenhausen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 0 days.

(21) Appl. No.: 12/329,560

(22) Filed: Dec. 6, 2008

(65) Prior Publication Data

US 2009/0147508 A1 Jun. 11, 2009

(30) Foreign Application Priority Data

Dec. 7, 2007 (DE) ..... 10 2007 059 132

(51) Int. Cl.
*F21V 33/00* (2006.01)

(52) U.S. Cl. ..... 362/249.02; 362/800; 362/249.06; 362/238

(58) Field of Classification Search ..... 362/800, 362/249.02, 249.06, 237, 238, 247, 241
See application file for complete search history.

(56) References Cited

U.S. PATENT DOCUMENTS

| | | | | |
|---|---|---|---|---|
| 6,936,855 | B1 | 8/2005 | Harrah | |
| 2003/0072156 | A1 * | 4/2003 | Pohlert et al. | 362/244 |
| 2007/0070625 | A1 * | 3/2007 | Bang | 362/240 |
| 2008/0080189 | A1 * | 4/2008 | Wang | 362/294 |
| 2008/0111471 | A1 | 5/2008 | Blumel et al. | |
| 2008/0137335 | A1 * | 6/2008 | Tsai et al. | 362/247 |

FOREIGN PATENT DOCUMENTS

| | | | |
|---|---|---|---|
| DE | 102006002275 | A1 | 7/2006 |
| DE | 102006033893 | A1 | 6/2007 |

OTHER PUBLICATIONS

English abstract of DE 102006033893 A1.

* cited by examiner

*Primary Examiner*—Laura Tso

(57) ABSTRACT

A lighting unit has at least two submounts, wherein each submount has multiple light sources. Furthermore, a lamp may have such a lighting unit.

18 Claims, 6 Drawing Sheets

LIGHTING UNIT AND LAMP

CROSS-REFERENCE TO RELATED APPLICATIONS

This application claims priority to German Patent Application No. 10 2007 059 132.4 filed Dec. 7, 2007, the contents of which is incorporated herein by reference in its entirety.

TECHNICAL FIELD

The invention relates to a lighting unit and a lamp.

BACKGROUND

Increasingly, light emitting diodes (LEDs) are used in lamps for universal illumination. Here, a light composition onto a target color location (chromaticity coordinates) is particularly effected in such a way, that a light of differently colored LEDs is homogeneous at an exit face of the lamp and has a preset color.

In bright lamps a plurality of LEDs is operated. In this case the problem arises, that due to thermal as well as electrical effects no longer all of the LEDs can be mounted directly side by side.

However, with the plurality of LEDs being arranged accordingly, it is optically complex to achieve a respective homogeneous light composition.

SUMMARY

According to various embodiments, the above mentioned disadvantages can be avoided and in particular a notedly efficient alternative for a homogeneous lighting unit can be specified, such as a lamp and/or a spotlight.

According to an embodiment, a lighting unit, may comprise at least two submounts, wherein each submount comprises multiple light sources.

According to a further embodiment, at least two light sources of the submounts may comprise different colors. According to a further embodiment, the at least two submounts each may comprise light sources with substantially identical characteristics. According to a further embodiment, the lighting unit may comprise multiple substantially identically assembled submounts. According to a further embodiment, the light sources may comprise substantially identical characteristics when the light sources comprise at least one of a substantially equal color, a substantially equal brightness, and a difference in brightness which is not discriminable by the human eye. According to a further embodiment, the lighting unit may comprise a plurality of submounts arranged in different locations of the lighting unit with a substantially common illumination direction. According to a further embodiment, a predetermined color composition for each submount may be preset by means of a ratio of the illuminating faces of the light sources. According to a further embodiment, the predetermined color composition may be adjustable by means of differing numbers of light sources of predetermined color. According to a further embodiment, the predetermined color composition may be adjustable by means of varying or increasing or decreasing the illuminating face of at least one light source. According to a further embodiment, the submounts can be connected in series. According to a further embodiment, light sources on different submounts can be connected in series. According to a further embodiment, light sources of equal color on different submounts can be connected in series. According to a further embodiment, the lighting unit may comprise a mounting face or a printed circuit board, wherein the submounts are at least partially countersunk or concealed in the mounting face or the printed circuit board. According to a further embodiment, the submount may be or may comprise at least one printed circuit board for at least one of accommodation and mounting of the light sources as follows: —a metal core printed circuit board; —a ceramic printed circuit board; —a printed circuit board made of FR4 material. According to a further embodiment, the light sources on the submount can be at least one of connected and attached at least by one of means of conductors and means of wire bonds. According to a further embodiment, lenses for light composition may be provided in each submount. According to a further embodiment, the lighting unit may be applicable in a lighting system, in a lamp or in a spotlight. According to a further embodiment, the light source may comprise at least one illuminant or at least one LED. According to a further embodiment, the lighting unit may comprise more than 6 LEDs or more than 12 LEDs.

According to another embodiment, a lamp may comprise such a lighting unit as described above.

BRIEF DESCRIPTION OF THE DRAWINGS

Exemplary embodiments of the invention are illustrated and described in the following by means of the drawings.

It shows.

DETAILED DESCRIPTION

Figure 1B:
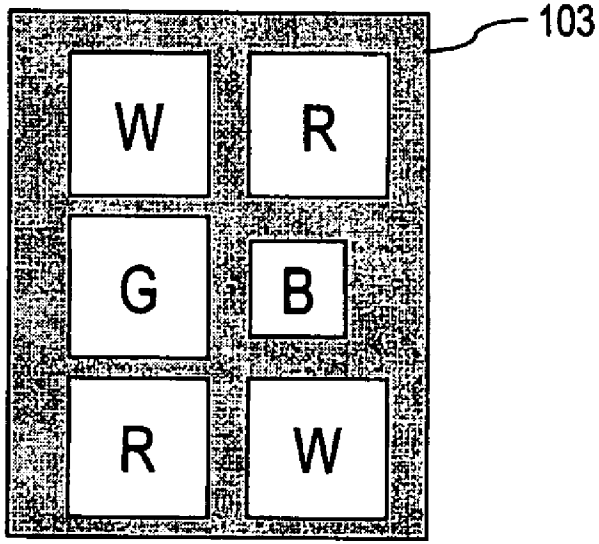
FIGS. 1A and 1B different embodiments of a submount comprising multiple LEDs or LED chips.

According to various embodiments, a lighting unit may comprise at least two submounts, wherein each submount comprises multiple light sources.

Herein, the term submount denotes a device, such as a printed circuit board, onto which the light sources are arranged. In particular, LEDs may be coupled to the submount thermally and/or electrically.

Thus it is possible to provide a scalable lighting unit by means of the submounts, wherein for example depending on a required light output a respective number of submounts may be provided. Furthermore, the use of the submounts allows for an efficient thermal design, since particularly a conduction of heat may take place for each submount. Also, with this approach it is possible to set a color location (chromaticity coordinates) for each submount which may be smoothly merged to an overall color location (chromaticity coordinates) for the lighting unit.

According to a further embodiment, at least two light sources of the submount exhibit differing colors.

In particular, a plurality of light sources, particularly LEDs with differing and/or substantially similar wavelengths may be arranged on or thermally coupled to the submount.

According to a further embodiment, the at least two submounts comprise light sources with substantially identical characteristics. For this, the submounts may comprise light sources of the same type. Alternatively it is feasible that the single light sources match within predetermined tolerance parameters and thus exhibit substantially identical characteristics regarding their brightness and/or their wavelength(s).

In particular according to an embodiment, the lighting unit comprises submounts substantially assembled identically. At least a part of the submounts provided in the lighting unit (optionally also all submounts) may each comprise light sources of the same type and light sources arranged in the same way respectively. Thus it is possible in a highly effective way to provide larger and more powerful lighting units (increased light output) having substantially the same color location (chromaticity coordinates).

According to a further embodiment, light sources have substantially identical characteristics when the light sources have a substantially equal color and/or a substantially equal brightness, particularly in such a way that a difference in brightness may not be discriminated by the human eye.

Furthermore according to an embodiment, the lighting unit comprises a plurality of submounts that are arranged at different locations of the lighting unit with a substantially common direction of beam.

According to a further embodiment, a predetermined color composition is presettable for each submount by means of a ratio of the illuminating faces of the light sources.

According to a further embodiment, the predetermined color composition is adjustable by differing numbers of light sources with preset color.

Thus, a color location (chromaticity coordinates) of the submount may be achieved by using light sources with a given illuminating face and the color required in each case is produced by the illuminating face of the light source, that is to mean by the number of light sources or by a modified face of one or more light sources.

According to a further embodiment, the preset color composition is adjustable by means of varying, in particular by means of enlarging or decreasing the illuminating face of at least one light source.

According to a further embodiment, the submounts are connected in series.

It can be preferred that the submounts are formed such that they easily may be connected in series. To do this the connections are preferably formed on both sides of the submount such that a part of the wiring is carried out by means of the submounts themselves.

According to a further embodiment, light sources on different submounts are connected in series. Particularly light sources of equal color on different submounts may be connected in series.

According to a further embodiment, the lighting unit comprises a mounting surface, particularly a printed circuit board, wherein the submounts are at least partly countersunk or concealed in the mounting surface.

According to a further embodiment, the submount comprises at least one printed circuit board for the acceptance and/or the mounting of the light sources as follows:

a metal core printed circuit board;

a ceramic printed circuit board;

a printed circuit board made of FR4 material.

According to a further embodiment, the light sources on the submount are connected and/or attached by means of conductors and/or by means of wire bonds.

According to a further embodiment, lenses for light composition are provided for each submount.

Favorably simple lenses may be provided for each submount which output the composed color location (chromaticity coordinates) of the submount. Accordingly, also for the lighting unit simple lenses may be provided, since the composition of the colors already takes place for each submount.

It is also a possibility that the lighting unit may be inserted into a light system, into a lamp or into a spotlight.

Also, according to a further embodiment, the light source comprises at least one illuminant, in particular at least one LED.

Particularly, the LED may be a LED chip.

According to a further embodiment, the lighting unit comprises more than 6 LEDs, in particular more than 12 LEDs.

According to a further embodiment, a lamp may comprise a lighting unit as specified herein.

It is to be noted here, that the denotation LED or light emitting diode used herein also comprises a LED chip.

According to the approach disclosed herein multiple, for example 4 to 12 LEDs (LED chips), are arranged on a submount in a predetermined numerical ratio of the LEDs or of the illuminating faces.

Preferably, the submount comprises a printed circuit board to accommodate the LEDs. Here it may be a ceramic printed circuit board, a metal core printed circuit board or a printed circuit board made of FR4 material. The printed circuit board may comprise conductors for attaching the LEDs. Also, it is possible that the LEDs may be connected to the printed circuit board by means of wire bonds. Furthermore, the LEDs may be mounted onto a thermally conductive material of the printed circuit board, for example copper. As an example, differently colored LEDs may be arranged on the submount in a specific ratio. Alternatively, the differently colored illuminating faces provided by the LEDs may exhibit a specific ratio.

Example:

| white | green | blue | red | yellow |
|---|---|---|---|---|
| 15 $mm^2$ | 3 $mm^2$ | 1.5 $mm^2$ | 1.5 $mm^2$ | 1.5 $mm^2$ |

Accordingly, multiple submounts may be provided in a lamp or a lighting unit. In doing so, in particular substantially "identical" submounts may be combined with each other in a lamp. Such "identical" submounts are in particular designed in such a way that they substantially provide a light composition which is adapted for use in the lighting unit. Preferably, to do so identical or similar LEDs are respectively provided on the multiple submounts of the lighting unit, wherein the similarity for example is comprised of LEDs which have substantially the same color;

LEDs which are perceivable to the human eye as "equally bright" (for this the LEDs particularly have differences in brightness of at most +/−16%);

LEDs having a dominant wavelength with an accuracy of 5 nm or 10 nm;

that a average dominant wavelength of multiple LEDs of equal color on a submount is similar to a average dominant wavelength on a adjacent submount;

that a average brightness of multiple LEDs of equal color on a submount is similar to a average brightness on a adjacent submount;

that with white Chip-Level-Conversion (CLC) chips besides the brightness also the color location (chromaticity coordinates) is similar, for example within a McAdams Ellipse with for example 3, 5 or 10 threshold units. In CLC Chips a phosphor is deposited directly on the (blue) chip and, by the composition of the blue light and the light converted by the phosphor on chip level, it produces substantially white light.

Advantageously, also a combination of different kinds and types of colors may be white, for example a cold white or a warm white, for adjustment of a differently appearing color temperature.

In the case that for example a color composition (color location) would not be adjustable on the submount by means of an integer ratio of LEDs, LEDs with a smaller or larger chip surface than the other LEDs may also be used.

Example:

| white | green | blue | red | yellow |
|---|---|---|---|---|
| $5 \times 1$ mm$^2$ | $3 \times 1$ mm$^2$ | 0.5 mm$^2$ | 0.5 mm$^2$ | 0.5 mm$^2$ |

The Figures show different examples for submounts which for example are applicable in lamps.

Figure 1A:
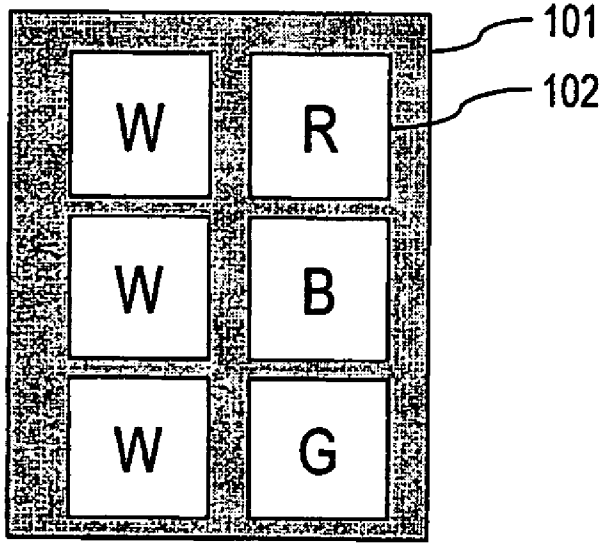

FIG. 1A shows multiple LEDs or LED chips 102, which are arranged on a submount, for example on a ceramic printed circuit board 101. The ceramic printed circuit board preferably comprises conductors and/or wire bonds to connect the LEDs. The LEDs have differing colors, wherein the following abbreviations are used:

W white,

R red,

B blue,

G green,

Y yellow.

Accordingly, submount 101 comprises three white LEDs, one red LED, one blue LED and one green LED. The LEDs of FIG. 1A all have approximately the same illuminating face.

FIG. 1B shows a submount 103, which except for a smaller blue LED (reduced face which illuminates blue) corresponds to submount 101 of FIG. 1A. By means of decreasing the percentage of blue an overall color of submount 103 results which in comparison to FIG. 1A is changed.

Figure 2A:
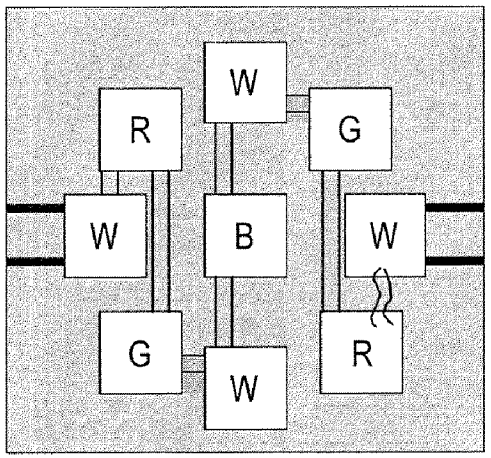
FIG. 2A to 2C different embodiments of a submount comprising a plurality of LEDs or LED chips.
Figure 2B:
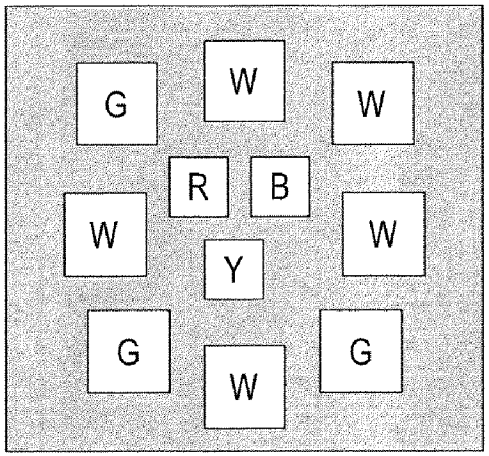
Figure 2C:
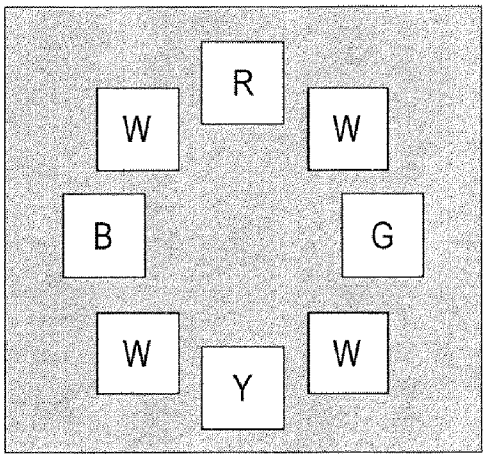

FIG. 2A, FIG. 2B and FIG. 2C show different alternatives of the distribution of LEDs on submounts.

Figure 3:
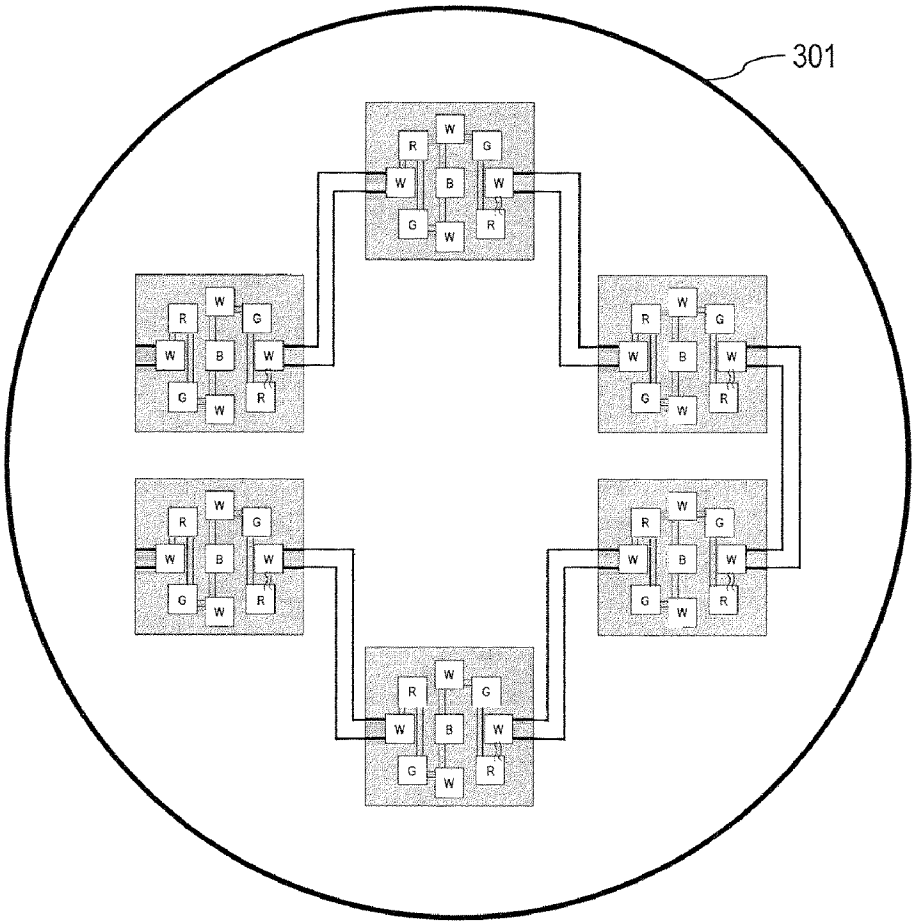
FIG. 3 to FIG. 6 different embodiments of lamps comprising various submounts.

FIG. 3 shows a lamp 301 comprising six submounts of the type as shown in FIG. 2A. This corresponds to a lamp with 24 white LEDs, 12 red LEDs, 12 green LEDs and 6 blue LEDs.

Figure 4:
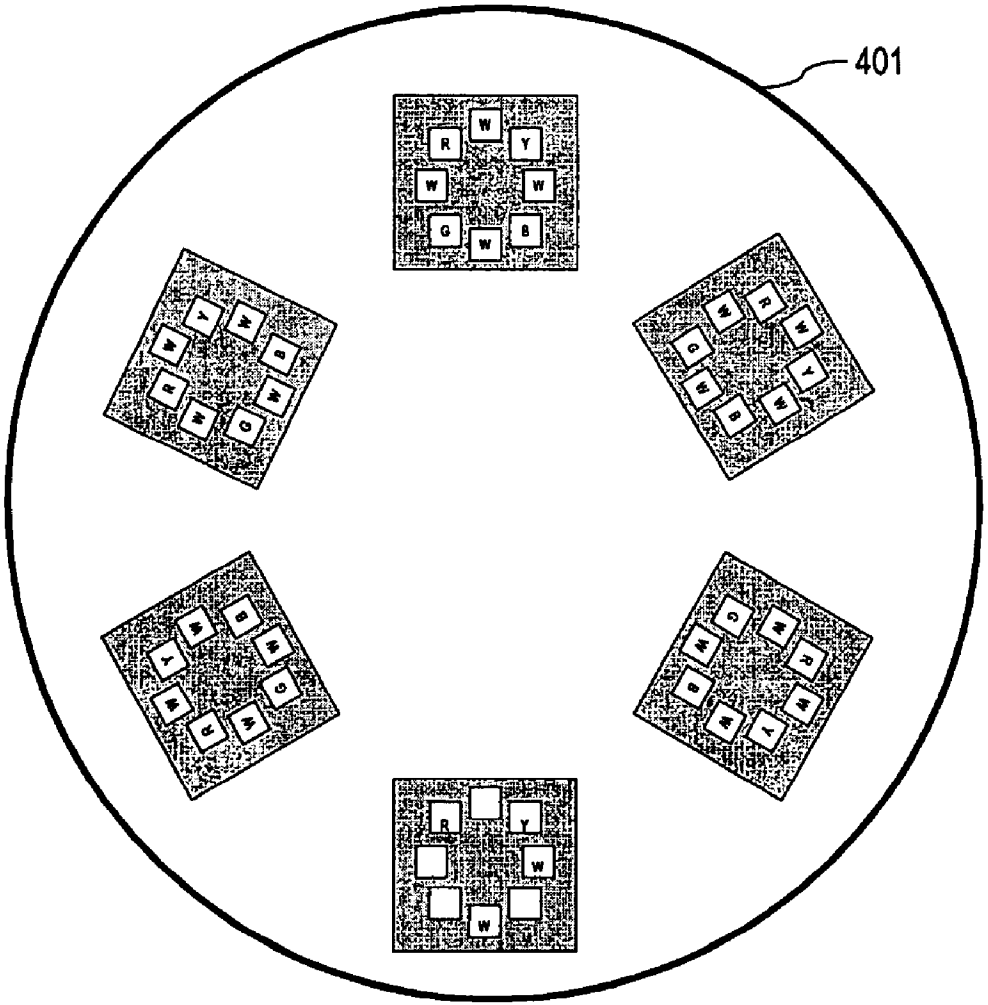

FIG. 4 shows a lamp 401 with submounts twisted against each other with 24 white LEDs and 6 red, yellow, green and blue LEDs each. The twisted submounts have the advantage that a connection in series is simplified and a narrower ring structure is allowed.

Figure 5:
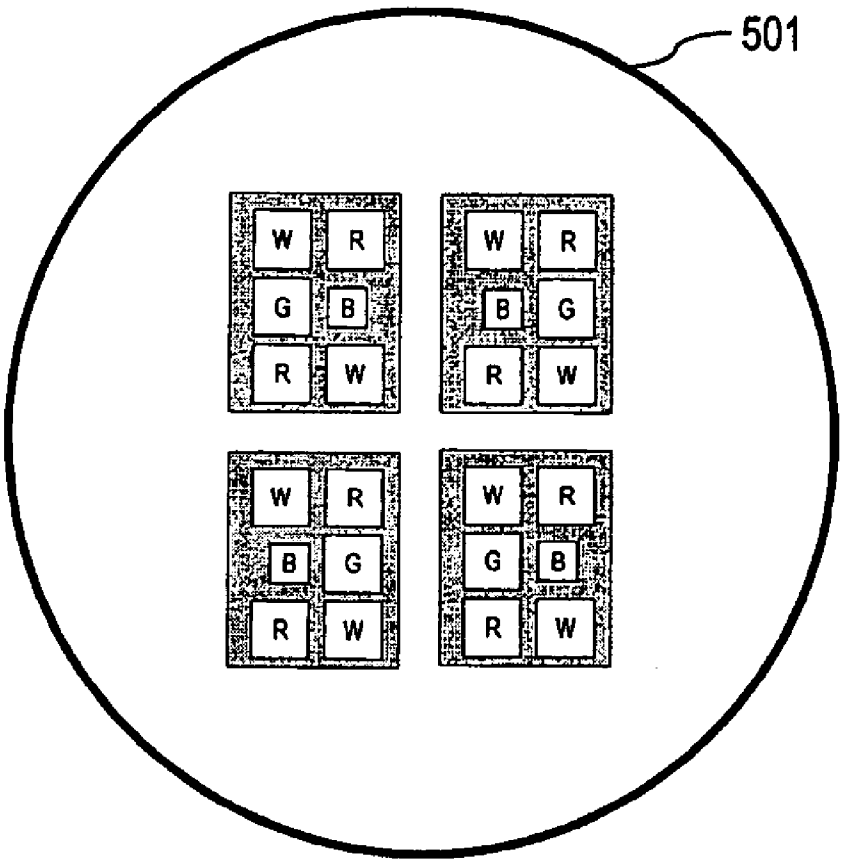

FIG. 5 shows a lamp 501 with 4 submounts according to FIG. 1B. Therefore, lamp 501 comprises 8 white LEDs, 4 green LEDs and 4 small blue LEDs.

Figure 6:
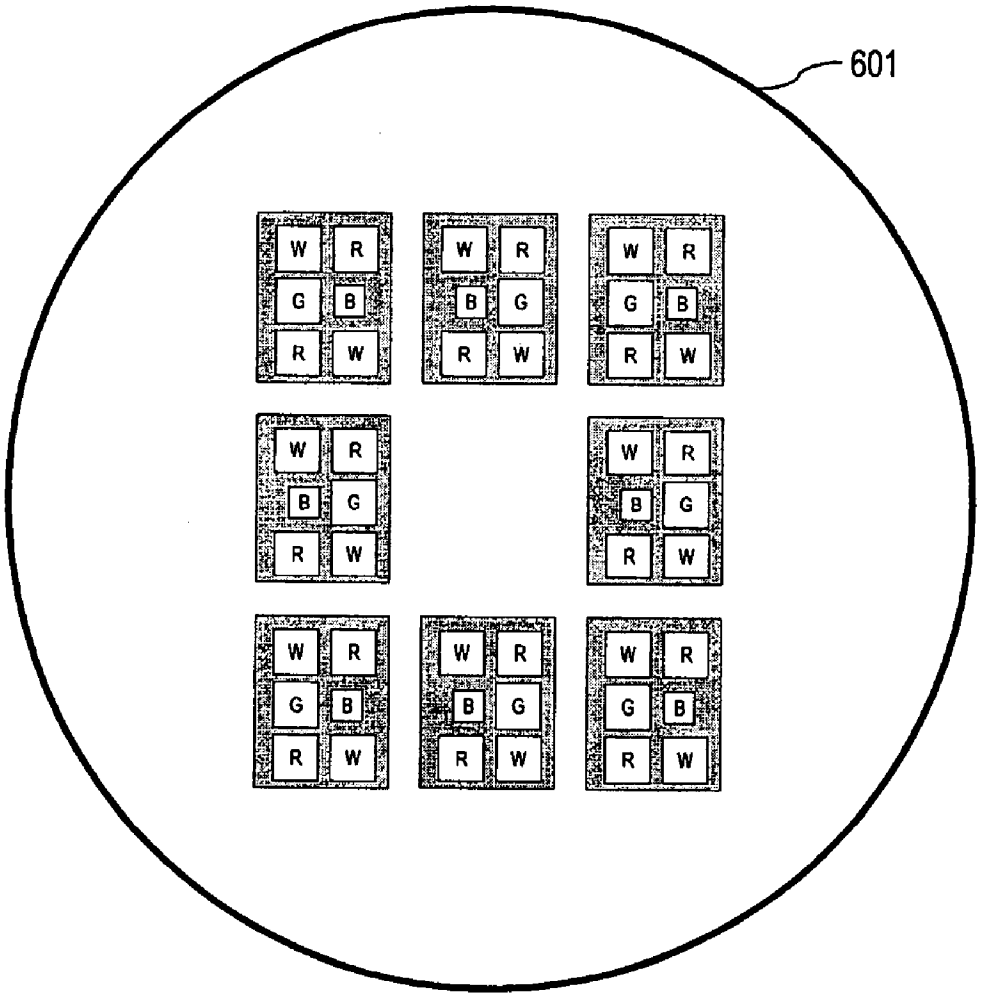

FIG. 6 shows a lamp 601 using 8 submounts according to FIG. 1B. Therefore, a doubling of the light output results in comparison with lamp 501 of FIG. 5.

Further advantages:

a. When driven by the same current the submounts provide the same light color as well as the same brightness. The light is pre-composed as a result of the spatial proximity of the LEDs on the submount. Each submount may be provided with own lenses. Alternatively or in addition lenses may be provided across the submounts by means of which an overall composition is achieved.

b. The generation of heat of each submount is comparable, respectively the heat may be dissipated form each submount systematically. By means of a given number of LEDs in each submount a more simple thermal design may be used.

c. The faces of the LED chips are effectively utilized.

d. Substantially identical devices may be produced and processed. This applies likewise to the LEDs and the submounts. Hereby production as well as logistics is considerably simplified.

e. By means of the substantially equal submounts the lighting unit may be scaled virtually free. Thus differently formed lamps and/or lamps having different sizes may be realized using a high amount of equal parts (submounts).

f. Different types of submounts may be in one lighting unit. For example, not all of the submounts of a lighting unit or a lamp have to be equal. Differing submounts may be used deliberately to achieve a predetermined color location (chromaticity coordinates) and/or a respective color location gradient.

What is claimed is:

1. A lighting unit, comprising at least two submounts, wherein each submount comprises multiple light sources, each with a light exit area;

wherein a predetermined color composition for each submount can be preset by means of a ratio of the area of the light exit areas of the light sources;

wherein the predetermined color composition is adjustable by means of varying or increasing or decreasing a light exit area of at least one light source.

2. The lighting unit according to claim 1, wherein at least two light sources of the submounts comprise different colors.

3. The lighting unit according to claim 1, wherein the at least two submounts each comprise light sources with substantially identical characteristics.

4. The lighting unit according to claim 1, comprising multiple substantially identically assembled submounts.

5. The lighting unit according to claim 3, wherein the light sources comprise substantially identical characteristics in the case where the light sources are of a substantially equal color, or of substantially equal brightness, wherein a difference in brightness is not discriminable by the human eye.

6. The lighting unit according to claim 1, comprising a plurality of submounts arranged in different locations of the lighting unit with a substantially common illumination direction.

7. The lighting unit according to claim 1, wherein the predetermined color composition is adjustable by means of differing numbers of light sources of predetermined color.

8. The lighting unit according to claim 1, wherein the submounts are connected in series.

9. The lighting unit according to claim 1, wherein light sources on different submounts are connected in series.

10. The lighting unit according to claim 9, wherein light sources of equal color on different submounts are connected in series.

11. The lighting unit according to claim 1, wherein the lighting unit comprises a mounting face or a printed circuit board, wherein the submounts are at least partially countersunk or concealed in the mounting face or the printed circuit board.

12. The lighting unit according to claim 1, wherein the submount is or comprises at least one printed circuit board for at least one of accommodation and mounting of the light sources as follows:

a metal core printed circuit board;

a ceramic printed circuit board;

a printed circuit board made of FR4 material.

13. The lighting unit according to claim 1, wherein the light sources on the submount are at least one of connected and attached at least by one of means of conductors and means of wire bonds.

14. The lighting unit according to claim 1, wherein lenses for light manipulation are provided in each submount.

15. The lighting unit according to claim 1, wherein the lighting unit is applicable in a lighting system, in a lamp or in a spotlight.

16. The lighting unit according to claim 1, wherein the light source comprises at least one LED.

17. The lighting unit according to claim 16, comprising more than 6 LEDs.

18. A lamp, comprising a lighting unit according to claim 1.

* * * * *